United States Patent [19]

Sakai et al.

[11] Patent Number: 4,457,130

[45] Date of Patent: Jul. 3, 1984

[54] AIR SPINNING NOZZLE UNIT

[75] Inventors: Shoji Sakai; Michiaki Fujiwara; Nobunori Kubota; Koshi Noda, all of Kyoto; Toshifumi Morihashi, Shiga, all of Japan

[73] Assignee: Murata Kikai Kabushiki Kaisha, Kyoto, Japan

[21] Appl. No.: 335,221

[22] Filed: Dec. 28, 1981

[30] Foreign Application Priority Data

Oct. 13, 1981 [JP] Japan ..... 56-152717[U]
Oct. 13, 1981 [JP] Japan ..... 56-152718[U]

[51] Int. Cl.[3] ..... D01H 1/13
[52] U.S. Cl. ..... 57/328; 57/333
[58] Field of Search ..... 57/328, 333, 350, 908

[56] References Cited

U.S. PATENT DOCUMENTS

| | | | |
|---|---|---|---|
| 3,380,242 | 4/1968 | Richmond et al. | 57/350 X |
| 3,650,103 | 3/1972 | Farrar et al. | 57/333 X |
| 3,722,198 | 3/1973 | Gotzfried | 57/333 X |
| 4,112,658 | 9/1978 | Morihashi | 57/333 X |
| 4,114,358 | 9/1978 | Tsuchida et al. | 57/333 X |
| 4,142,354 | 3/1979 | Nakahara | 57/328 |

*Primary Examiner*—Donald Watkins

[57] ABSTRACT

An air nozzle for spinning yarn is positioned adjacent a pair of drafting rollers. The space between a cap covering the nozzle and the nozzle itself forms a tank for the air to be jetted through the nozzle. A tapered throttle located behind the nozzle reduces resistance to air exiting from the jetting ports.

49 Claims, 5 Drawing Figures

AIR SPINNING NOZZLE UNIT

BACKGROUND OF THE INVENTION

1. Field of the Invention

This device relates to an air spinning nozzle for producing spun yarns.

2. Description of the Prior Art

In an air spinning device such as that illustrated in U.S. Pat. No. 4,142,354, it is desirable that the nozzle tip of the spinning device be disposed in the closest proximity possible to the nip point of the front roller pair of the drafting device (typically on the order of 7.5 mm from nozzle tip to nip point). This is a prerequisite for obtaining a regularly twisted yarn and operation condition in good order.

Prior art air spinning units have been provided with nozzles internally fixed to the nozzle housing. Support of the nozzles is easy and secure, but the distance between the nozzle and the front roller pair is inevitably apt to be long, since the nozzle is buried in the nozzle housing.

In such nozzle units having a nozzle buried in the nozzle housing, an air tank adapted to communicate with air jetting ports, which in turn communicate with the nozzle hole, is easily formed. Air jetting conditions are improved by the presence of such an air tank since the air tank acts as an accumulator for air entering the air jetting ports and thereby controls and stabilizes any variations and pulsations in the air current exiting the air jetting ports. On the other hand, incorporation of such an air tank typically requires that the distance between the nozzle and the front roller pair be increased.

In an air spinning nozzle unit it is also desirable that the air jetted from jetting ports receive the lowest possible degree of resistance while exiting toward the discharge outlet, thereby enabling spinning of superior yarn twisted in good condition. However, a nozzle unit of the type in which a throttle is disposed behind the nozzle creates high resistance to the air due to the throttle's structural complexity.

An objective of the present invention is to provide an air spinning nozzle unit in which the nozzle is set in the nozzle housing, securely supported, adapted to be free of such disadvantage as described above, and, in addition, equipped with an air tank.

A further objective of the present invention is to insure spinning of yarn twisted in good condition, reducing resistance to the jetted air to the lowest degree, even in a nozzle unit in which the throttle is located behind the nozzle.

SUMMARY OF THE INVENTION

In accordance with the present invention, these and other objectives are achieved by providing a structure in which the nozzle is fixed to the front end portion of the nozzle housing. An air tight cap, for covering the head of the nozzle housing and nozzle, is fitted onto the aforesaid front end of the nozzle housing. A path formed between said cap and the front end portion of the nozzle housing is provided. The air-tight cap is adapted to communicate with air jetting ports bored in the nozzle for making up in the cap a space for the air tank. A tapered throttle located behind the nozzle reduces resistance to air exiting from the jetting ports.

DESCRIPTION OF THE PREFERRED EMBODIMENT

The following detailed description is of the best presently contemplated mode of carrying out the invention. This description is not to be taken in a limiting sense, it is made merely for the purpose of illustrating the general principles of the invention since the scope of the invention is best defined by the appended claims.

Figure 1:
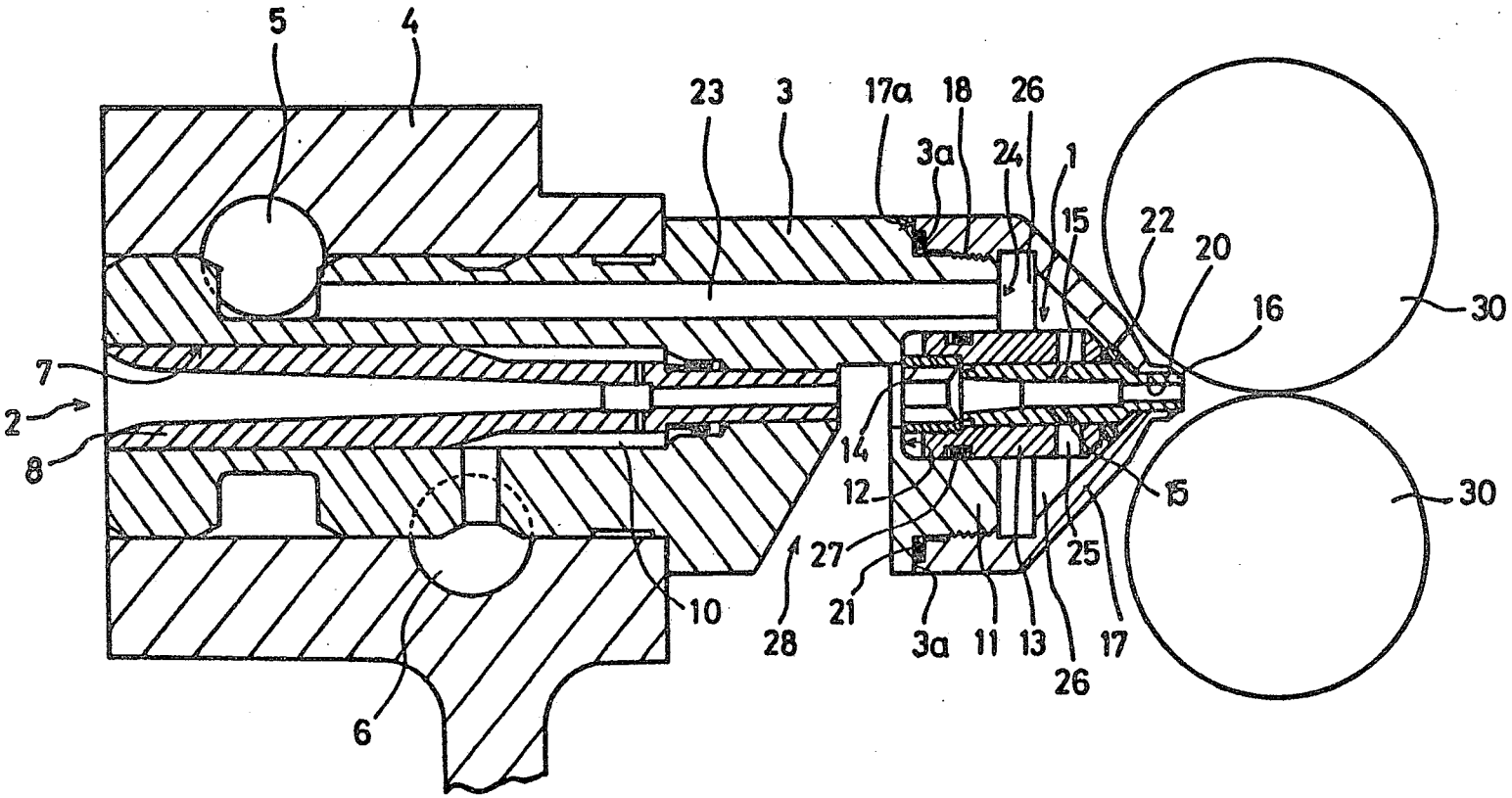
FIG. 1 is a vertical sectional view of an air spinning nozzle unit according to the present invention.
Figure 2:
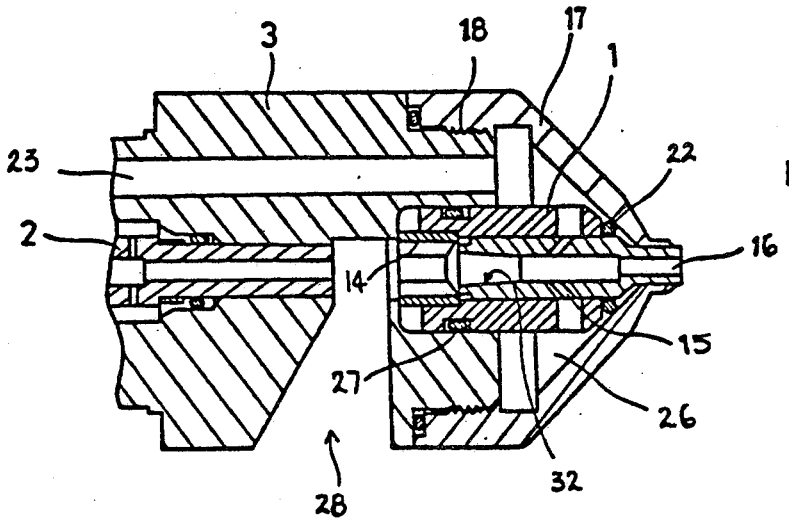
FIG. 2 is an enlarged sectional view of an air spinning nozzle unit according to the present invention.
Figure 5:
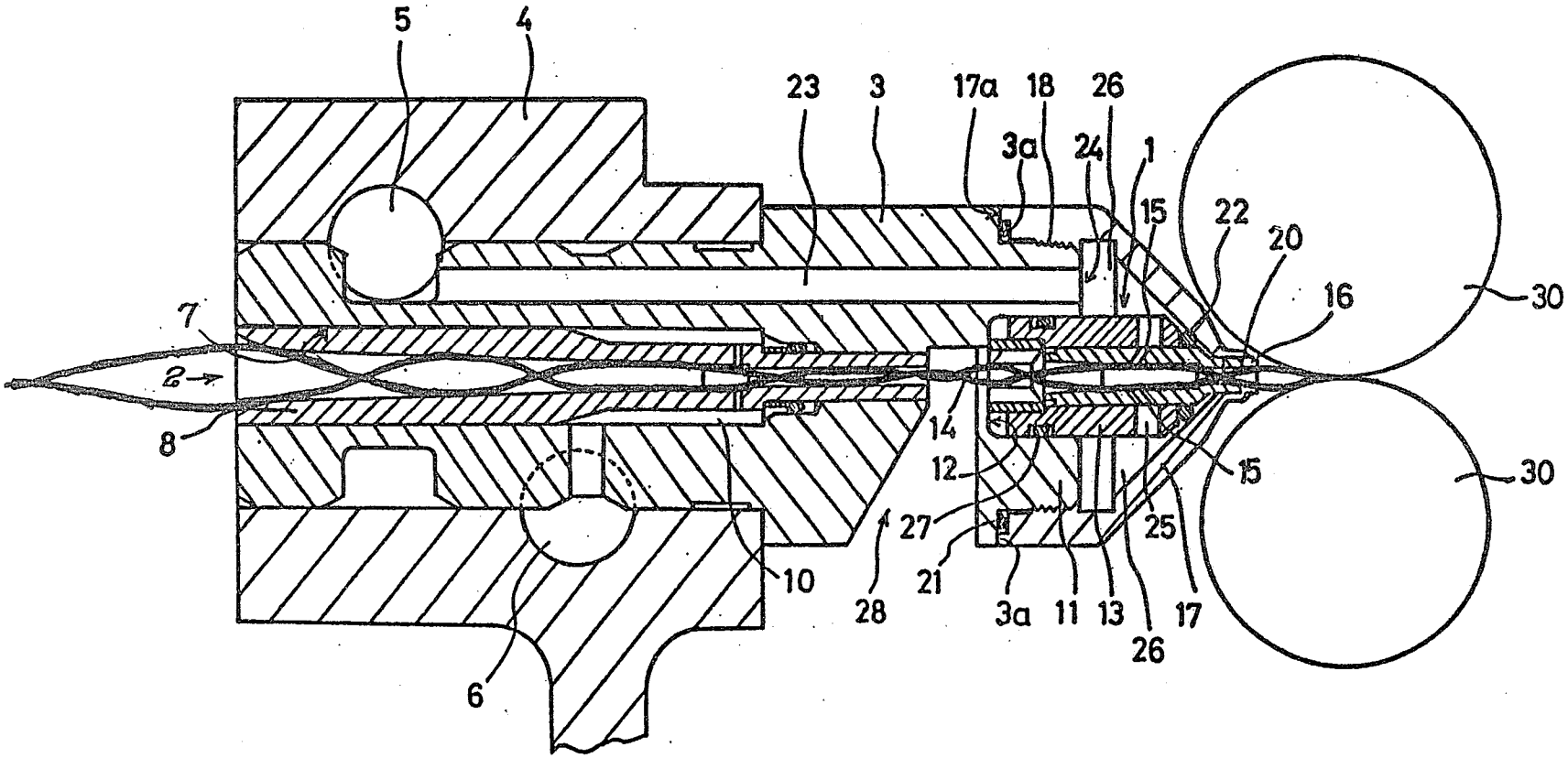
FIG. 5 is the vertical sectional view of FIG. 1 illustrating the position of the yarn in a nozzle unit according to the present invention.

Referring to FIGS. 1, 2, and 5, a nozzle unit comprises two nozzles 1 and 2 internally provided in a single nozzle housing 3. Air is introduced into the nozzles 1 and 2 through upper and lower air feeding paths 5 and 6, respectively, provided in the nozzle holder 4. Yarn is drafted through rollers 30 and is then spun in nozzles 1 and 2.

The second nozzle 2 is composed of a nozzle pipe 8 inserted into the nozzle pipe insertion hole 7 penetrating the rear half portion of the nozzle housing 3. Compressed air is jetted from the air feed 6 to the interior of the second nozzle 2 through the gap 10 formed around the nozzle pipe 8.

The front end portion 11 of the nozzle housing 3 is provided with a recess 12 in the central portion thereof into which the first nozzle 1 and the throttle 14 are fitted.

The first nozzle 1 is provided with a nozzle pipe 16 having air jetting ports 15 opened in the hole bored along the axial center of the first nozzle 1. In the preferred embodiment of the invention both the nozzle pipe 16 and the throttle 14 are made of ceramic.

The rear half portion of the first nozzle 1 is inserted into the recess 12, whereas the front half portion of the first nozzle 1 is adapted to extend outside the recess 12. A cap 17 in the shape of a cone is screwed down on the front end portion 11 of the nozzle housing 3 so as to cover the part of the first nozzle 1 lying outside the recess 12.

A tip hole 20 whose diameter is sized so as to be capable of fitting on the nozzle pipe 16 is bored in the tip of the cap 17 and the nozzle pipe 16 is inserted through the tip hole 20. O-rings 21 and 22 are provided in the gap between the end face **17*a* of the cap 17 and the end face 3*a* of the nozzle housing 3, as well as the gap between the back side of the tip of cap 17 and the first nozzle 1, for keeping these engaging parts air tight. An air path 23 running through the nozzle housing 3 opens into the air-tight space between the nozzle housing 3 and the cap 17. Jetting ports 15 of the first nozzle 1 are adapted to communicate with said space, thereby creating in said conical space an air tank 26** for the compressed air.

The numeral 27 indicates an O-ring fitting into a gap between the first nozzle 1 and said recess 12, and numeral 28 represents an air escape cutout formed by cutting off a part of the nozzle housing 3.

Although the first nozzle 1 is set within the nozzle housing 3, it is disposed in the foremost end position on the back side of the cap 17 of the nozzle housing 3. The cap 17 is in the shape of a cone, thereby permitting the front roller pair 30 to be disposed in the closest possible position to the first nozzle 1 and at the same time utilizing a gap between the back side of the cap and the nozzle housing 3 as an air tank 26.

A path for compressed air leading to the first nozzle 1 comprises air feed 5, air path 23, air tank 26, communication path 25, and jetting ports 15.

As will be understood from the foregoing, in an air spinning nozzle unit according to this device, spinning of quality yarn is ensured due to an arrangement which enables the first nozzle 1 to be disposed in the closest proximity possible to the front roller pair 30 (approximately 7.5 mm) for spinning of quality yarn under stable operation conditions, and a space on the back side of the nozzle cap 17 to be utiilized as an air tank 26 (without increasing of the distance between the nozzle and the front roller pair) for improving air jetting conditions in the nozzle.

Further, in said embodiment, the cap 17 is screwed down on the nozzle housing 3 and so can be easily removed when required, enabling easy replacement of the first nozzle 1 and the throttle 14 for cleaning of inner parts thereof. Attachment and removal of the cap 17 is made easier if the exterior of the cap 17 is formed to engage tools such as a wrench or the like.

By providing O-ring 21 between the cap 17 and the nozzle housing 3 in the groove formed by faces 17*a* and 3*a* of the cap 17 and the nozzle housing 3, respectively, as shown in FIG. 1, the cap is easily put on and off with less resistance and, nevertheless, air tightness is kept sufficient.

Figure 3:
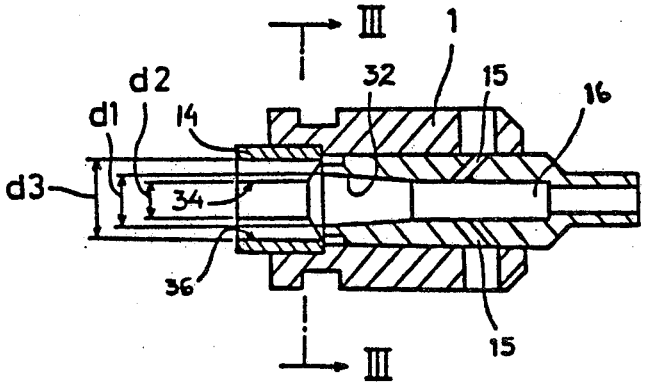
FIG. 3 is a sectional view showing the throttle portion thereof.
Figure 4:
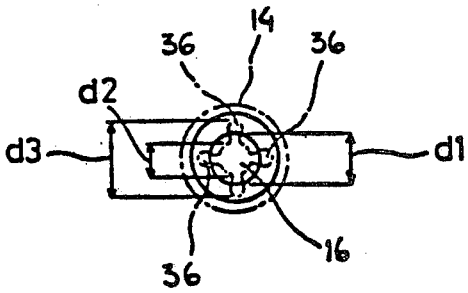
FIG. 4 is a perspective view taken along the line III—III in FIG. 3.

Referring to FIGS. 2, 3 and 4, air to be jetted is introduced into the nozzle hole 16 of the first nozzle 1 through guide path 23, air tank 26 and jetting ports 15. The jetted air is transferred backward while whirling and discharged toward air escape cutout 28 through the throttling hole 34 and disposed radially therearound. The inner diameter of the nozzle hole 16 of the first nozzle 1 on the side behind the jetting ports 15 is gradually enlarged toward the rear side to form a taper configuration 32. The diameter of the nozzle hole 16 is $d_1$ at the rearmost end thereof, getting larger than the inner diameter $d_2$ of the throttling hole 34 but smaller than the diameter $d_3$ of an imaginary circle passing through the outer edges of air escape grooves 36 of the throttle 14.

The air jetted from the jetting ports 15 into the nozzle hole 16 is transferred toward the throttle 14 while whirling in the hole 16 and inflating along the tapered portion 32. Even at the time of transfer from the nozzle 1 to the throttle 14 the air is not subjected to an abrupt change of direction or shape of flow path. The air is thereby discharged through the air escape cutout 28 while under reduced pressure, after being smoothly transferred to and through the throttle 14.

Therefore, even when the structure of an air spinning nozzle unit according to this device is complicated, the air jetted from the jetting ports 15 exits while receiving a minimum degree of resistance in the direction toward the air escape cutout 28 for discharging the air and ensures spinning of superior yarn twisted in good condition.

What is claimed is:

1. An air spinning nozzle unit internally provided with a nozzle proper, characterized in that:

said nozzle proper is set on the front end of a nozzle housing;

a cap is fitted onto the front end of said nozzle housing so as to air-tightly cover said front end and said nozzle proper;

an air guiding path is provided to communicate externally with an air-tight gap formed between said cap and said front end of the nozzle housing; and said air-tight gap is adapted to communicate with at least one port for jetting air toward a nozzle hole bored in the nozzle proper such that said gap is utilized as a tank acting as an accumulator for externally supplied, pressurized air to be jetted.

2. An air spinning nozzle unit as set forth in claim 1, wherein said cap is screwed down on the front end of said nozzle housing.

3. An air spinning nozzle unit as set forth in claim 2, wherein a part with which tools are engaged is provided on the exterior of said cap.

4. An air spinning nozzle unit as set forth in claim 3, wherein said nozzle proper is inserted into a recess formed on the front end portion of the nozzle housing so that the front half portion thereof remains outside said recess, and wherein said cap, when formed into a hollow conical shape, is fitted on the front end of the nozzle housing, wherein said air-tight gap between said nozzle housing and the cap is formed into a conical space.

5. An air spinning nozzle unit having a throttle disposed behind a first nozzle, characterized in that the lengthwise rear portion of a nozzle hole, bored lengthwise through said first nozzle, is formed to be in taper configuration in a way that the inner diameter of said rear portion is gradually enlarged with the apporach to the throttle and, at the rearmost end thereof, is larger in diameter than the diameter of a throttling hole bored through said throttle, and smaller in diameter than the diameter of an imaginary circle passing through the maximum diametric distance of a plurality of radially disposed, axially engraved air escape grooves formed into the wall of said throttling hole.

6. A jet spinning device for producing spun yarn comprising:

drafting means for drawing said yarn fluid jet means, immediately adjacent said drafting means, for spinning said yarn.

7. A device as in claim 6 further comprising tank means, located within said device and disposed immediately adjacent to said fluid jet means, said tank means being adapted to communicate with an external source of pressurized fluid and with said fluid jet means, such that said tank means is available for storing and stabilizing the fluid used in said fluid jet means.

8. A device as in claim 7 wherein said fluid jet means further comprises:

a first nozzle means immediately adjacent said drafting means a second nozzle means subsequent to said first nozzle means; and a nozzle housing unit by which said first nozzle means and said second nozzle means are connected and aligned.

9. A device as in claim 8 further comprising:

a cap secured to said nozzle housing unit, surrounding said first nozzle means wherein said tank means is located in the space between said cap and said first nozzle means.

10. A device as in claim 9 wherein said cap is in the shape of a cone.

11. A device as in claim 10 wherein said drafting means further comprises a pair of rollers.

12. A device as in claim 9 wherein said cap is removably secured to said nozzle housing unit, thereby facilitating maintenance and replacement of said first nozzle means.

13. A device as in claim 11 wherein the apex of said cone shaped cap is adjacent the line bisecting the centers of said rollers.

14. A device as in claim 8 wherein said first nozzle means further comprises:

at least one jet port through which said fluid is jetted a nozzle hole through which said fluid passes and a throttle containing a hole through which said fluid is discharged.

15. A device as in claim 14 wherein the diameter of said nozzle hole is gradually enlarged in the direction toward the throttle from the region containing at least one jet port, thereby forming a tapered configuration.

16. A device as in claim 15 wherein said throttle is in the form of an annular ring containing a plurality of radially disposed air escape grooves formed axially in the inner wall of said ring.

17. A device as in claim 16 wherein the diameter of said nozzle hole at the rearmost end thereof is larger than the inner diameter of said throttle hole but smaller than the diameter of an imaginary circle passing through the maximum diameter formed by said air escape grooves.

18. A device as in claim 13 wherein said cap is removably secured to said nozzle housing unit, thereby facilitating maintenance and replacement of said first nozzle means.

19. A device as in claim 18 wherein said first nozzle means further comprises:

at least one jet port through which said fluid is jetted;

a nozzle hole through which said fluid passes; and a throttle containing a hole through which said fluid is discharged.

20. A device as in claim 19 wherein the diameter of said nozzle hole is gradually enlarged toward the throttle from the region containing at least one jet port, thereby forming a tapered configuration.

21. A device as in claim 20 wherein said throttle is in the form of an annular ring containing a plurality of radially disposed air escape grooves formed axially in the inner wall of said ring.

22. A device as in claim 21 wherein the diameter of said nozzle hole at the rearmost end thereof is larger than the inner diameter of said throttle hole but smaller than the diameter of an imaginary circle passing through the maximum diameter formed by said air escape grooves.

23. A device as in claim 12 wherein said cap is in the shape of a cone.

24. A device as in claim 23 wherein said first nozzle means further comprises:

at least one jet port through which said fluid is jetted;

a nozzle hole through which said fluid passes; and a throttle containing a hole through which said fluid is discharged.

25. A device as in claim 24 wherein the diameter of said nozzle hole is gradually enlarged toward the throttle, from the region containing at least one jet port, thereby forming a tapered configuration.

26. A device as in claim 25 wherein said throttle is in the form of an annular ring containing a plurality of radially disposed air escape grooves formed axially in the inner wall of said ring.

27. A device as in claim 26 wherein the diameter of said nozzle hole at the rearmost end thereof is larger than the inner diameter of said throttle hole but smaller than the diameter of an imaginary circle passing through the maximum diameter formed by said air escape grooves.

28. A device as in claim 10 wherein the apex of said cone is immediately adjacent to the nip point, as is commonly defined, of said drafting means.

29. A device as in claim 28 wherein said cap is removably secured to said nozzle housing unit, thereby facilitating maintenance and replacement of said first nozzle means.

30. A device as in claim 29 wherein said first nozzle means further comprises:

at least one jet port through which said fluid is jetted;

a nozzle hole through which said fluid passes; and a throttle containing a hole through which said fluid is discharged.

31. A device as in claim 30 wherein the diameter of said nozzle hole is gradually enlarged toward the throttle from the region containing at least one jet port, thereby forming a tapered configuration.

32. A device as in claim 31 wherein said throttle is in the form of an annular ring containing a plurality of radially disposed air escape grooves formed axially in the inner wall of said ring.

33. A device as in claim 32 wherein the diameter of said nozzle hole at the rearmost end thereof is larger than the inner diameter of said throttle hole but smaller than the diameter of an imaginary circle passing through the maximum diameter formed by said air escape grooves.

34. A device as in claim 6 wherein said fluid jet means further comprises:

a first nozzle means immediately adjacent to said drafting means;

a second nozzle means subsequent to said first nozzle means; and a nozzle housing unit by which said first nozzle means and said second nozzle means are connected and aligned.

35. A device as in claim 34 wherein said first nozzle means further comprises:

at least one jet port through which said fluid is jetted;

a nozzle hole through which said fluid passes; and a throttle containing a hole through which said fluid is discharged.

36. A device as in claim 35 wherein the diameter of said nozzle hole is gradually enlarged toward the throttle from the region containing at least one jet port, thereby forming a tapered configuration.

37. A device as in claim 36 wherein said throttle is in the form of an annular ring containing a plurality of radially disposed air escape grooves formed axially in the inner wall of said ring.

38. A device as in claim 37 wherein the diameter of said nozzle hole at the rearmost end thereof is larger than the inner diameter of said throttle hole but smaller than the diameter of an imaginary circle passing through the maximum diameter formed by said air escape grooves.

39. A device as in claim 17 wherein an air escape cutout is formed in the nozzle housing unit intermediate between the throttle exit from the said first nozzle means and the entrance to said second nozzle means.

40. A device as in claim 33 wherein an air escape cutout is formed in the nozzle housing unit intermediate between the throttle exit from the said first nozzle means and the entrance to said second nozzle means.

41. A device as in claim 22 wherein an air escape cutout is formed in the nozzle housing unit intermediate between the throttle exit from the said first nozzle means and the entrance to said second nozzle means.

42. A device as in claim 27 wherein an air escape cutout is formed in the nozzle housing unit intermediate between the throttle exit from the said first nozzle means and the entrance.

43. A device as in claim 38 wherein an air escape cutout is formed in the nozzle housing unit intermediate between the throttle exit from the said first nozzle means and the entrance to the said nozzle means.

44. A device as in claim 6 wherein said drafting means further comprises a pair of rollers.

45. An air spinning nozzle unit as set forth in claim 4 wherein a second nozzle means are internally provided, characterized in that:

said second nozzle means are set within the rear portion of said nozzle housing, such that said second nozzle means are aligned with the previously characterized nozzle proper;

a gap is formed between the outer wall of said second nozzle means and the inner wall of said nozzle housing;

said gap is sealably enclosed at the longitudinal ends of said second nozzle means so as to form an air-tight gap;

an air guiding path from an external supply of pressurized air is opened to said gap; and said air-tight gap is adapted to communicate with a plurality of ports for jetting air toward a nozzle hole bored longitudinally through said second nozzle means.

46. An air spinning nozzle unit as set forth in claim 45 wherein an air escape cutout is formed in said nozzle housing intermediate between the exit from said nozzle proper and the entrance to said second nozzle means.

47. An air spinning nozzle unit as set forth in claim 5 having a second nozzle means disposed behind the said throttling hole and longitudinally aligned therewith.

48. An air spinning nozzle unit as set forth in claim 47 wherein a nozzle housing is provided to contain and hold in alignment said first nozzle, throttle, and second nozzle means.

49. An air spinning nozzle unit as set forth in claim 48 wherein an air escape cutout is formed in the nozzle housing intermediate between the throttle hole and the second nozzle means.

* * * * *